US011103914B2

(12) United States Patent
Manita et al.

(10) Patent No.: US 11,103,914 B2
(45) Date of Patent: Aug. 31, 2021

(54) CAN MANUFACTURING METHOD, CAN MANUFACTURING DEVICE, CAN, AND CAN MANUFACTURING TOOL SET

(71) Applicant: TOYO SEIKAN CO., LTD., Tokyo (JP)

(72) Inventors: Kiyosumi Manita, Yokohama (JP); Mitsuhiko Aoyagi, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 16/628,387

(22) PCT Filed: Jul. 31, 2018

(86) PCT No.: PCT/JP2018/028631
§ 371 (c)(1),
(2) Date: Jan. 3, 2020

(87) PCT Pub. No.: WO2019/026898
PCT Pub. Date: Feb. 7, 2019

(65) Prior Publication Data

US 2020/0215597 A1 Jul. 9, 2020

(30) Foreign Application Priority Data

Jul. 31, 2017 (JP) ..... JP2017-148630
Sep. 15, 2017 (JP) ..... JP2017-177917

(51) Int. Cl.
*B21D 51/26* (2006.01)
*B21D 51/38* (2006.01)
*B65D 1/16* (2006.01)

(52) U.S. Cl.
CPC ..... *B21D 51/2607* (2013.01); *B21D 51/2638* (2013.01); *B21D 51/38* (2013.01); *B65D 1/165* (2013.01)

(58) Field of Classification Search
CPC ..... B21D 51/2638; B21D 51/38; B21D 51/2607; B44B 5/0009; B44B 5/0047; B44B 5/0014
See application file for complete search history.

(56) References Cited

U.S. PATENT DOCUMENTS 425,807 A * 4/1890 Leach ..... B44B 5/0047 101/5
5,100,017 A 3/1992 Ishinabe et al.
(Continued)

FOREIGN PATENT DOCUMENTS

CN 101708525 A 5/2010
CN 201553354 U 8/2010
(Continued)

OTHER PUBLICATIONS

Machine translation of JP 2004-123231, Retrieved from Espacenet Dec. 10, 2020, 10 Pages. (Year: 2001).*
(Continued)

*Primary Examiner* — Gregory D Swiatocha
(74) *Attorney, Agent, or Firm* — Sughrue Mion, PLLC

(57) ABSTRACT

A can 1 is provided with a mouth part (4), a shoulder part (3), and a body part (2). The shoulder part (3) of the can (1) is decorated, without damaging the shoulder part (3), by forming at least one of a recess and a protrusion by a rotating process in which the shoulder part (3) is held between a receiver (11a), having a concave-convex shape, of an inner roll (11) and an outer roll (12) having a convex-concave shape corresponding to the concave-convex shape of the receiver (11*a*) of the inner roll (11).

9 Claims, 9 Drawing Sheets

(56) References Cited

U.S. PATENT DOCUMENTS

| | | | | |
|---|---|---|---|---|
| 5,761,942 | A | 6/1998 | Johnson et al. | |
| 7,555,927 | B2 * | 7/2009 | Hanafusa | B21D 51/2615 72/349 |
| 2005/0115294 | A1 * | 6/2005 | Kanou | B65D 1/0223 72/121 |
| 2008/0069665 | A1 | 3/2008 | Hanafusa et al. | |
| 2015/0360279 | A1 | 12/2015 | Jentzsch et al. | |
| 2018/0250730 | A1 * | 9/2018 | Matsuo | F16H 7/12 |
| 2019/0106237 | A1 * | 4/2019 | Tanaka | B65D 1/42 |

FOREIGN PATENT DOCUMENTS

| | | | | |
|---|---|---|---|---|
| CN | 103803145 | A | | 5/2014 |
| EP | 0 377 985 | A1 | | 7/1990 |
| EP | 2 835 188 | A1 | | 2/2015 |
| JP | 4-11487 | Y1 | | 10/1929 |
| JP | 63-16823 | A | | 1/1988 |
| JP | 3-3538 | U | | 1/1991 |
| JP | 3-180228 | A | | 8/1991 |
| JP | 8-4862 | B2 | | 1/1996 |
| JP | 2002-256366 | A | | 9/2002 |
| JP | 2002256366 | A | * | 9/2002 |
| JP | 2003-340539 | A | | 12/2003 |
| JP | 2003340539 | A | * | 12/2003 |
| JP | 2004-123231 | A | | 4/2004 |
| JP | 2004123231 | A | * | 4/2004 |
| JP | 2004-168346 | A | | 6/2004 |
| JP | 2007091330 | A | * | 4/2007 |
| JP | 2008-126264 | A | | 6/2008 |
| JP | 4473381 | B2 | * | 6/2010 |
| JP | 2011147983 | A | * | 8/2011 |
| WO | 2006/043347 | A1 | | 4/2006 |

OTHER PUBLICATIONS

Machine translation of JP 2002-256366, Retrieved from Espacenet Dec. 10, 2020, 9 Pages. (Year: 2002).*

Machine translation of JP 4473381, Retrieved from Espacenet Dec. 10, 2020, 3 Pages. (Year: 2010).*

Machine translation of JP 2007-091330, Retrieved from Espacenet Dec. 10, 2020, 15 Pages. (Year: 2007).*

Machine translation of JP 2003-340539, Retrieved from Espacenet Dec. 10, 2020, 6 Pages. (Year: 2003).*

Machine translation of JP 2011-147983, Retrieved from Espacenet Dec. 10, 2020, 8 Pages. (Year: 2011).*

Communication dated Aug. 5, 2020, from the Chinese Patent Office in corresponding Application No. 201880049783.9.

International Search Report dated Sep. 25, 2018 from the International Searching Authority in International Application No. PCT/JP2018/028631.

IPRP issued Feb. 4, 2020 with Translation of Written Opinion dated Sep. 25, 2018 from the International Searching Authority in International Application No. PCT/JP2018/028631.

Communication issued Apr. 8, 2021 by the European Patent Office in corresponding application No. 18840891.8.

* cited by examiner

Fig. 8B Enlargement of B portion

CAN MANUFACTURING METHOD, CAN MANUFACTURING DEVICE, CAN, AND CAN MANUFACTURING TOOL SET

CROSS REFERENCE TO RELATED APPLICATIONS

This application is a National Stage of International Application No. PCT/JP2018/028631 filed Jul. 31, 2018, claiming priority based on Japanese Patent Application No. 2017-148630 filed Jul. 31, 2017 and Japanese Patent Application No. 2017-177917 filed Sep. 15, 2017.

TECHNICAL FIELD

The present invention relates a can decorated on a shoulder, a method for manufacturing the can, an apparatus for manufacturing the can, and a tool set for manufacturing the can.

TECHNICAL BACKGROUND

So far, as a can, a material in the form of having a thick-walled shoulder reduced in a diameter from a thin-walled cylindrical body, and a mouth has been provided, in which the mouth is sealed by double seaming with a can lid or by seaming with a metal cap.

Examples of decoration of the body of the can include printing applied thereto, and embossing applied thereto as disclosed in Patent Document 1. On the other hand, examples of decoration to the shoulder of the can include printing applied thereto as disclosed in Patent Document 2, and uneven patterns applied to the shoulder as disclosed in Patent Document 3 to 5.

When uneven patterns are applied to the shoulder of a thin-walled can in association with reduction of a wall thickness of the can due to resource saving in recent years, if a mold for forming the shoulder as disclosed in Patent Document 3 (reference sign 60 in FIG. 7) or in Patent Document 4 (reference sign 10 in FIG. 1) is pressed onto the shoulder of the can, the shoulder has been buckled. Moreover, also when the uneven patterns are formed by pressing a mold such as a groove forming tool disclosed in Patent Document 3 (reference sign 72 in FIGS. 8A and 8B) only from outward of the shoulder of the can, the shoulder of the thin-walled can has caused abnormal deformation.

RELATED ART DOCUMENT

Patent Documents

Patent Document 1: JP 2003-340539 A
Patent Document 2: JP 2004-168346 A
Patent Document 3: JP 2004-123231 A
Patent Document 4: US 201510360279 A1
Patent Document 5: CN 103803145 A

SUMMARY OF INVENTION

Technical Problem

The present invention has been made in consideration of such circumstances, and an objective of the present invention is to provide a method for manufacturing a can, capable of suppressing damage onto a shoulder of the can, an apparatus for manufacturing the can, the can, and a tool set for manufacturing the can.

Solution to Problem

A method for manufacturing a can according to the present invention covers a method for manufacturing a can having a mouth, a shoulder, and a body, including: an inner roll having a receiver, which has at least one of a concave portion and a convex portion, for receiving the shoulder from inside; and an outer roll, which has at least one of a concave portion and a convex portion corresponding to the receiver of the inner roll, for pressing the shoulder from outside, wherein the inner roll and the outer roll are rotated relative to the can, in a state in which the receiver of the inner roll and the outer roll clamp the shoulder from outside and inside.

Moreover, a can according to the present invention covers a can, including a mouth, a shoulder, and a body, wherein the shoulder has at least one of a concave portion and a convex portion; an inside diameter of the mouth is 25 to 60 mm; and a maximum outside diameter of the shoulder is 50 to 70 mm.

In addition, a can according to the present invention covers a can, including a mouth, a shoulder, and a body, wherein the shoulder has at least one of a concave portion and a convex portion; and a ratio of a maximum outside diameter of the shoulder to an inside diameter of the mouth is 1.05 to 1.58.

Moreover, a tool set for manufacturing a can according to the present invention covers a tool set for manufacturing a can having a mouth, a shoulder, and a body, including: an inner roll having a receiver, which has at least one of a concave portion and a convex portion, for receiving the shoulder from inside; and an outer roll, which has at least one of a concave portion and a convex portion corresponding to the receiver of the inner roll, for pressing the shoulder from outside, wherein the receiver of the inner roll and the outer roll are rotated relative to the can, in a state in which the receiver of the inner roll and the outer roll clamp the shoulder from outside and inside.

Advantageous Effects of Invention

According to a method for manufacturing a can, an apparatus for manufacturing the can, and a tool set for the can as related to the present invention, rotating processing can be performed by pressing and clamping the shoulder of the can by an outer roll, in a state of supporting the shoulder of the can from an inner side of the can by a receiver of an inner roll, and therefore the shoulder of the can is hard to cause abnormal deformation even with a thin wall.

Moreover, according to the can related to the present invention, a maximum outside diameter of the shoulder is not excessively large relative to an inside diameter of a mouth of the can, and a shoulder width of the can is sufficiently large. Therefore, the can is suitable for rotating processing of the shoulder, and the inner roller can be inserted from the mouth of the can, and the shoulder of the can be firmly supported by the receiver of the inner roll, and therefore results in the can in which the shoulder of the can is hard to cause abnormal deformation by processing.

BRIEF DESCRIPTION OF DRAWINGS

FIGS. 8A and 8B are explanatory diagrams schematically showing a cross-sectional view of an upper part of a can, and schematically showing an inner roll according to the present embodiment.

DESCRIPTION OF EMBODIMENTS

Figure 1:
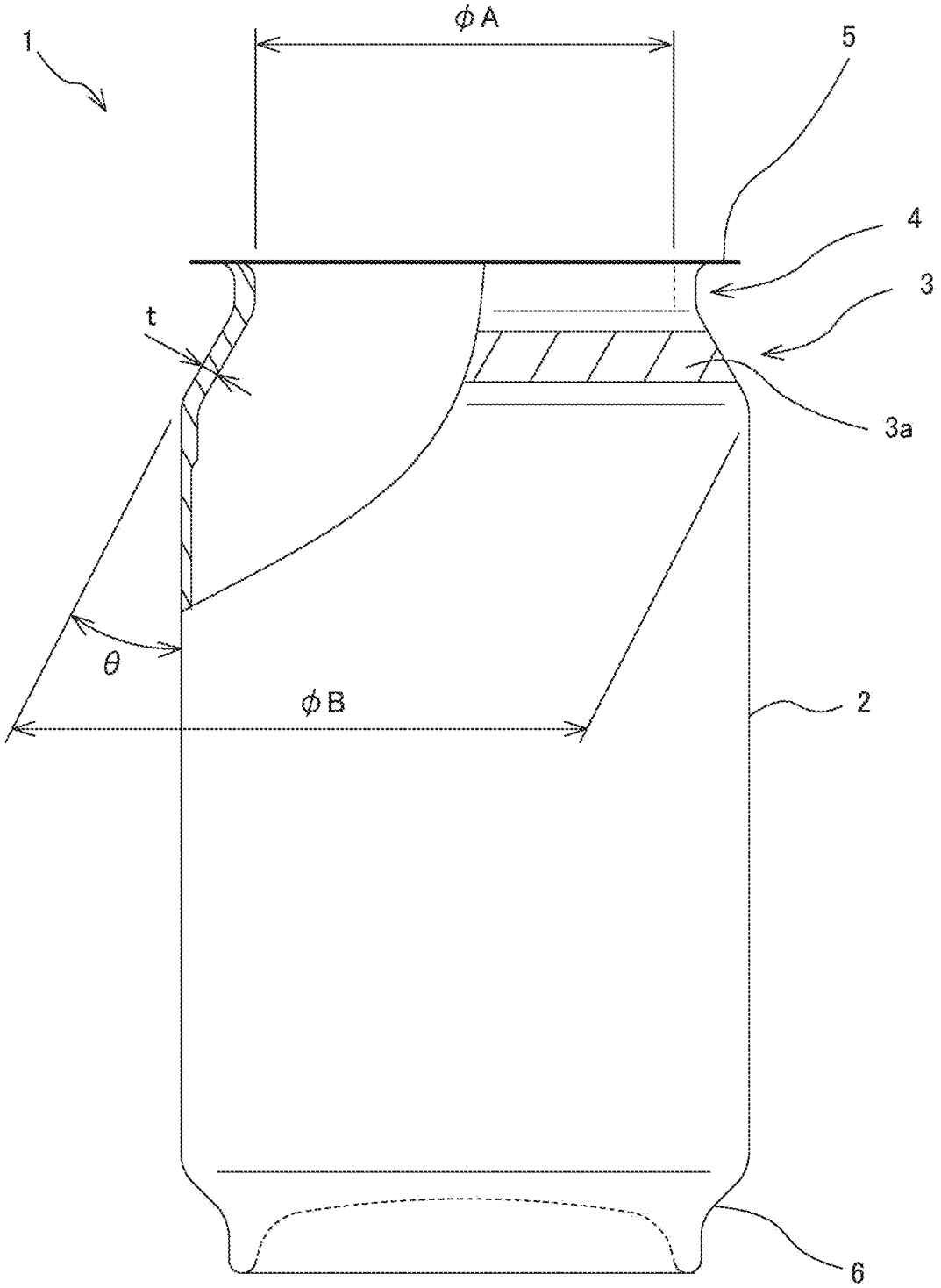
FIG. 1 shows a schematic view including a partial cross section of a can according to a first embodiment of the present invention.

Preferable embodiments of the present invention will be described with reference to drawings.

First Embodiment

First, a can 1 according to a first embodiment will be described by using FIG. 1 or FIGS. 2A and 2B.

The can 1 is formed of a publicly-known metallic material used for the can, such as steel, tinplate, aluminum, aluminum alloy, or the like, for example. The can 1 ordinarily has a cylindrical body 2 having an outside diameter of 45 mmφ, 53 mmφ, 66 mmφ, or the like, a shoulder 3 which is connected to a side of an upper end of the body 2 in a can axis direction, and is reduced in a diameter toward upward (side of the mouth), and a mouth 4 which is connected to a side of an upper end of the shoulder 3 in the can axis direction, and extended upward. According to the abode-described configuration, the shoulder 3 is formed into a diameter reduced portion in which the diameter is reduced from a side of the body 2 toward a side of the mouth 4. A flange 5 is provided at an end of the mouth 4. A publicly-known can lid (not shown) is seamed around the mouth 4.

The can 1 has a chime portion 6 gradually reduced in the diameter toward downward on a side of a lower end (side of the bottom) of the body 2 of the can 1.

An inside diameter φA of the mouth 4 can be set to 25 to 60 mm, for example.

Moreover, a maximum outside diameter φB of the shoulder 3 (namely, it is an outside diameter of a part connecting the shoulder 3 and the body 2, and it becomes the same with the outside diameter of the body 2, when a side surface of the body 2 is formed into a straight shape) can be set to 50 to 70 mm, for example.

As shown in FIG. 1, a three-dimensionally shaped portion area 3*a* shown by hatching on the shoulder 3 is provided with the three-dimensionally shaped portion. The three-dimensionally shaped portion has at least one of a depressed concave portion and a raised convex portion.

A term "depressed concave portion" means a concave three-dimensional shape when viewed from an outside surface of the can, and a convex three-dimensional shape when viewed from an inside surface of the can. A term "raised convex portion" means a convex three-dimensional shape when viewed from the outside surface of the can, and a concave three-dimensional shape when viewed from the inside surface of the can.

Figure 2A:
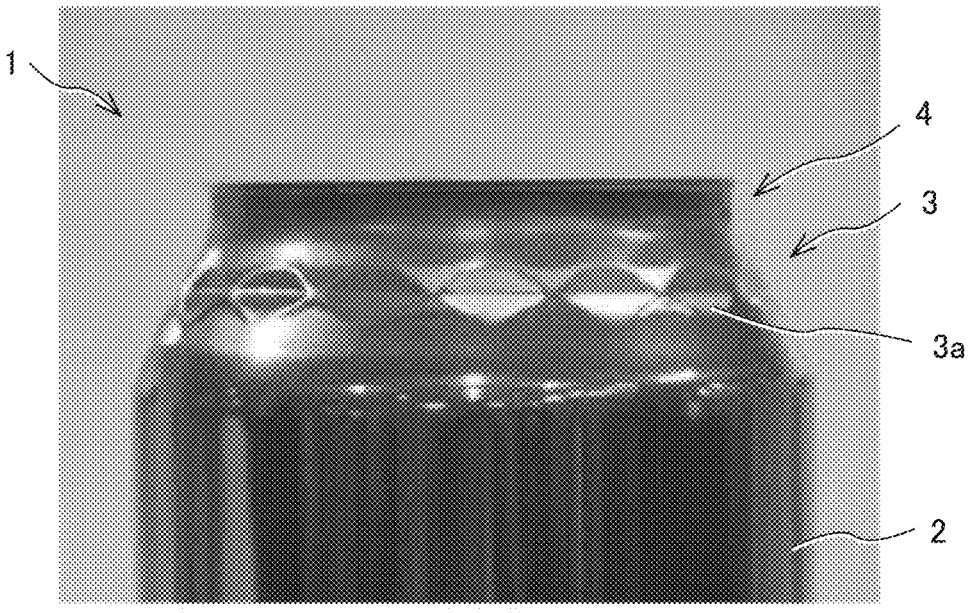
FIGS. 2A and 2B are diagrams showing an example of a three-dimensionally shaped portion of a shoulder of a can according to the first embodiment.

As shown in FIG. 2A, for example, the three-dimensionally shaped portion may be provided with a plurality of depressed concave portions having a same shape at an equal interval on a whole circumference. Alternatively, as shown in FIG. 2B, for example, the three-dimensionally shaped portion may be provided with the depressed concave portions which are different in a shape in a circumferential direction.

Figure 2B:
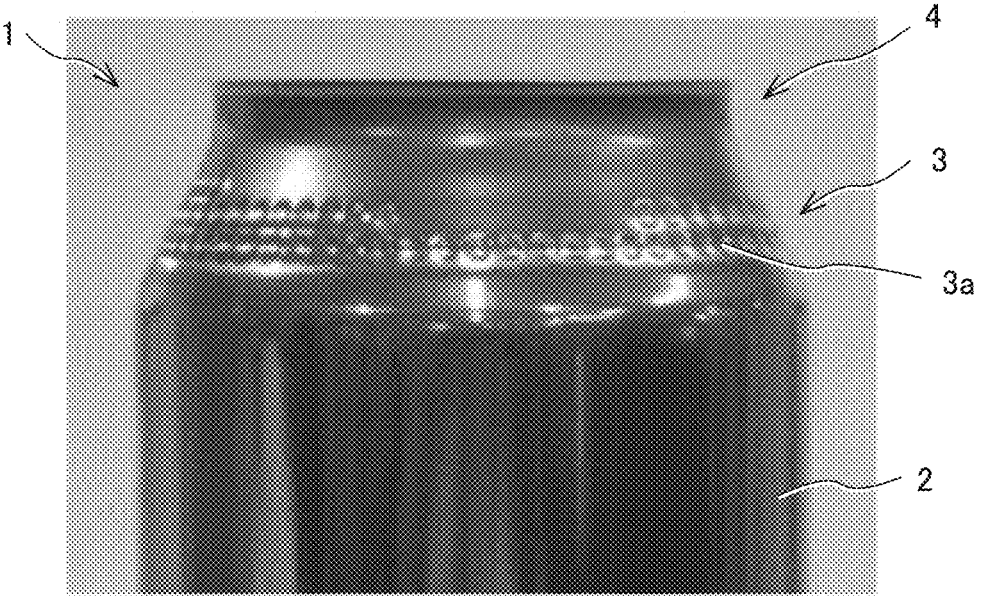

It should be noted that, in an example in FIG. 2B, in the three-dimensionally shaped portion, a plurality of rows along a height direction of the shoulder are aligned in the circumferential direction. In the plurality of rows, the plurality of depressed concave portions having the same shape are arranged in the different number (for example, 1 to 4). Thus, the shapes of the three-dimensionally shaped portions are different in the circumference of the shoulder 3.

In addition thereto, for example, the three-dimensionally shaped portion may have intermittently the depressed portions in part or a plurality of parts of the shoulder 3 in the circumferential direction. Moreover, the three-dimensionally shaped portion may have the raised convex portion in place of the depressed concave portion, or may be a mixture of the depressed concave portion and the raised convex portion. Moreover, when a plurality of the depressed concave portions and the raised convex portions are provided, all need not have the same shape. Further, the three-dimensionally shaped portion may have any one of the depressed concave portion or the raised convex portion, or may have one by one, respectively. The shape of the depressed concave portion or the raised convex portion may be a designed shape of a geometrical pattern, a character, a sign, a person, an animal, a plant, a vehicle, an appliance, scenery, food and drink, packaged food and drink, and the like, for example.

A depressed direction of the depressed concave portion or a raised direction of the raised convex portion can be appropriately set in consideration of appearance, a shape of the shoulder 3, a direction without interfering a moving direction of an inner roll 11 or an outer roll 12 described later, or the like.

A ratio of the maximum outside diameter φB of the shoulder of the can 1 to the inside diameter φA of the mouth of the can 1 is preferably 1.05 to 1.58. Such a ratio of the diameters is set, whereby a sufficiently large width of the shoulder 3 can be secured in the can 1, and therefore a sufficiently wide three-dimensionally shaped portion area 3*a* can be secured. Moreover, such a ratio is effective upon three-dimensionally shaped portion rotating processing of the shoulder 3 by clamping with the receiver 11*a* of the inner roll 11 and the outer roll 12 described later.

As a wall thickness t of the shoulder, a material as thin as 0.1 to 0.3 mm is preferable, and setting to 0.1 to 0.2 mm is more preferable. The wall thickness t of the shoulder is thus set, whereby three-dimensional decoration as in the three-dimensionally shaped portion can be applied to the shoulder 3 of the can 1 in which a material is reduced, and even if the three-dimensionally shaped portion is formed, a fine hole such as a pinhole is hard to be perforated. The three-dimensionally shaped portion can be processed, even with such a thin wall thickness of the shoulder, by three-dimensionally shaped portion rotating processing of the shoulder 3 by clamping with the receiver 11*a* of the inner roll 11 and the outer roll 12.

The shoulder 3 is processed in a reduced diameter, and therefore the wall thickness of the shoulder 3 may be greater than a wall thickness of the body 2. In this case, the shoulder 3 has sufficient strength, and therefore formation of the pinhole or the like during processing can be further suppressed, and buckling or the like caused by external force can also be suppressed.

The shoulder 3 according to the present embodiment is inclined as a circular truncated cone side form in a midrange in the height direction. An inclination angle θ is set to 10° to 50° (more preferably 25 to 45), whereby relative to the mouth 4 having a predetermined inside diameter φA of the mouth and the shoulder 3 having a predetermined maximum outside diameter φB of the shoulder, as inclination steepness of the shoulder 3 is larger (closer to vertical), a width of the shoulder 3 is increased, and a larger three-dimensionally shaped portion area 3*a* can be kept. Moreover, such setting is effective upon three-dimensionally shaped portion rotating processing of the shoulder 3 by clamping with the receiver 11*a* of the inner roll 11 and the outer roll 12 described later.

It should be noted that the inclination angle θ is an angle between a surface formed by extending the shoulder 3 to the side of the body 2, and the body 2.

Further, according to the above-described shape of the shoulder 3, such an effect can be produced as being capable of improving processability of the three-dimensionally shaped portion and the strength of the can, and capable of forming the can reduced in the diameter from the maximum outside diameter φB of the shoulder to the inside diameter φA of the mouth within the range in the height direction of the can effective to aesthetic appearance.

Next, a method for manufacturing the can 1 according to a first embodiment will be described by using FIGS. 3 to 5.

In the method for manufacturing the can 1, as a preceding process, a closed-end cylindrical intermediate formed body having the body 2 is manufactured by a publicly-known drawing and ironing or the like, and printing, painting or the like is applied to internal and external surfaces of the intermediate formed body, when necessary. Then, a shoulder 3P is formed by performing such processing to the intermediate formed body as die necking or roll necking (spin flow necking) configured of a plurality of publicly-known processes, or a combination of the die necking or the roll necking configured of the plurality of publicly-known processes.

Then, the mouth 4 having the flange 5 on an opening end is formed on the intermediate formed body by a publicly-known die flanger or a spin flanger, or the like.

Figure 3:
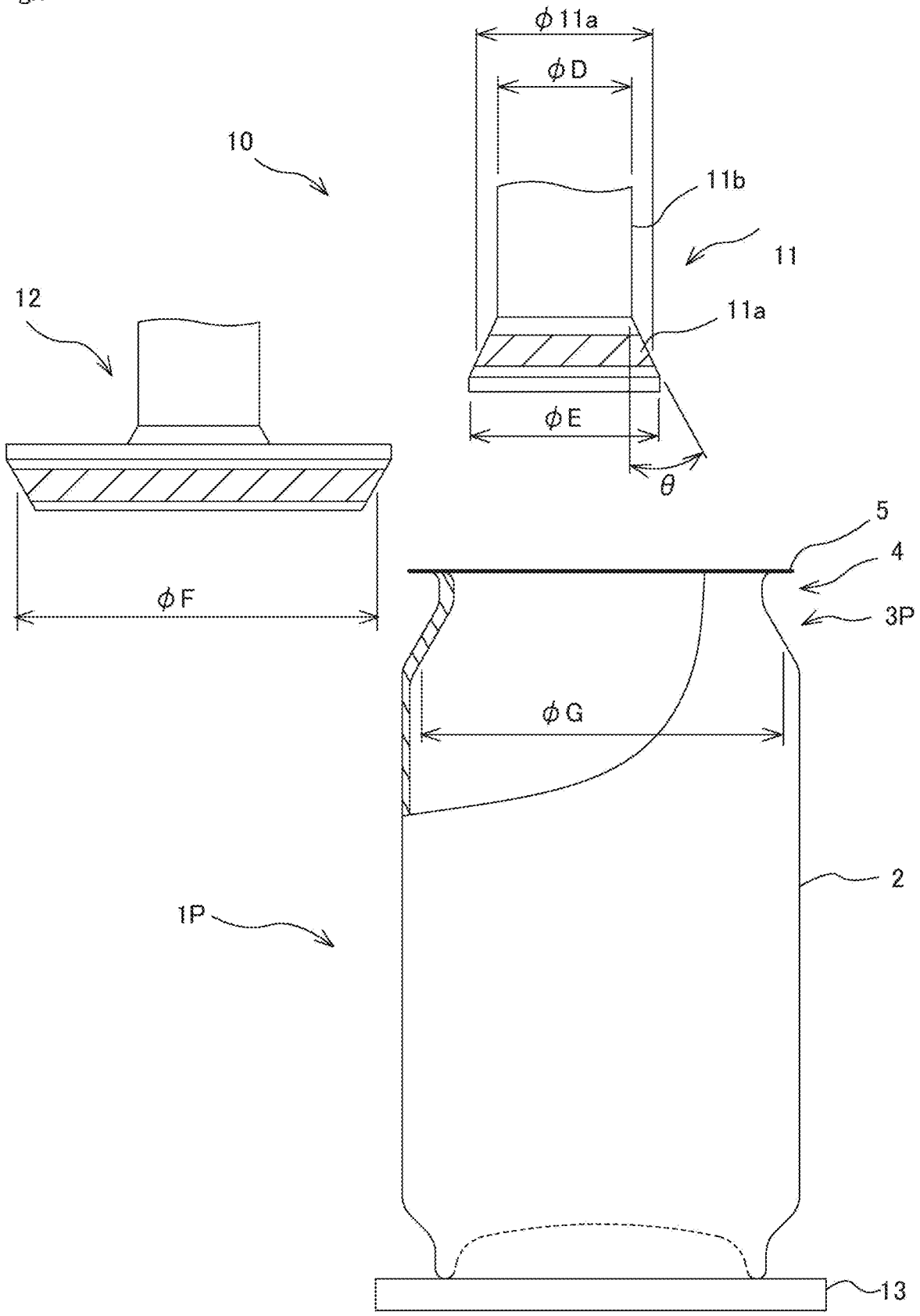
FIG. 3 shows a schematic view describing a three-dimensionally shaped portion processing device according to the first embodiment by using a schematic view including a partial cross section of a can.

Thus, a can 1P, which is the intermediate formed body of the can 1, as shown in FIG. 3 or the like, is manufactured.

Next, as shown in FIG. 3, the three-dimensionally shaped portion is formed on the shoulder 3P using a three-dimensionally shaped portion processing device 10 (or a apparatus for manufacturing the can). The three-dimensionally shaped portion processing device 10 has an inner roll 11 and an outer roll 12 as a tool set for manufacturing the can. A receiver 11*a* is provided at a bottom of the inner roll 11.

A shaft 11*b* and the receiver 11*a* may be connected by screw clamping, for example.

It should be noted that the receiver 11*a* is a part (step portion) which has the outside diameter larger than the diameter of the shaft 11*b*, and is provided on the inner roll 11 in a step form.

The receiver 11*a* of the inner roll 11 is provided with a pattern of a concave (concave portion) or a convex (convex portion) corresponding to the three-dimensionally shaped portion in the range shown by hatching. Moreover, the outer roll 12 is also provided with a pattern of a concave (concave portion) or a convex (convex portion) corresponding to the concave or the convex provided on the receiver 11*a* In the range shown by hatching.

Figure 4A:
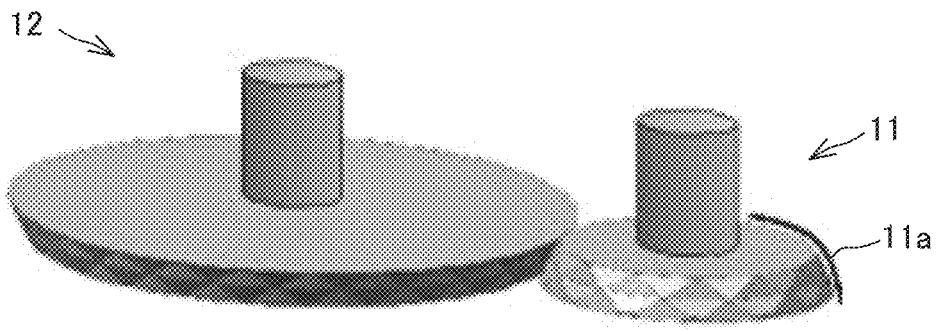
FIGS. 4A and 4B are explanatory diagrams showing an example of an inner roll and an outer roll of a three-dimensionally shaped portion processing device related to a method for manufacturing a can according to the first embodiment.

For example, the concave of the receiver 11*a* of the inner roll 11 and the convex of the outer roll 12 corresponding to the depressed concave shape of the shoulder 3 shown in FIG. 2A has a form shown in FIG. 4A. Similarly, the concave of the receiver 11*a* of the inner roll 11 and the convex of the outer roll 12 corresponding to the depressed concave shape of the shoulder 3 shown in FIG. 2B has a form shown in FIG. 4B.

The receiver 11*a* of the inner roll 11 only needs to have at least one of the concave and the convex according to the shape of the shoulder 3 of the can 1. More specifically, when the shoulder 3 has the raised convex portion, the receiver 11*a* only needs to have the concave. When the shoulder 3 has the depressed concave portion and the raised convex portion, the receiver 11*a* only needs to have the concave and the convex. The same shall apply also to the concave or the convex of the outer roll 12.

The shaft 11*b* serving as a rotating axis of the inner roll 11 is a solid or hollow shaft form having an outside diameter φD. With regard to the outside diameter φD of the shaft 11*b*, a cylinder having φ10 mm or more is preferable in the case of the solid shaft, and a cylinder having a wall thickness of 5 mm or more is preferable in the case of the hollow shaft, in view of the strength, although the outside diameter depends on the material.

A maximum outside diameter φE of the receiver 11*a* is smaller than the inside diameter φA of the mouth of the can 1P, whereby the inner roll 11 can be relatively inserted into or removed from the can 1P.

In the present embodiment, the ratio of the maximum outside diameter φB of the shoulder to the inside diameter φA of the mouth of the can 1P is set to 1.05 to 1.58. Therefore, in the three-dimensionally shaped portion area 3*a*, an effective extent can be secured, and the receiver 11*a* of the inner roll 11 can firmly support the shoulder 3P of the can 1P. Further the inner roll 11 can be inserted into or removed from the mouth 4, even if the shaft 11*b* sufficiently secures a thickness or a wall thickness in view of strength.

An external shape of the receiver 11*a* of the inner roll 11 is preferably the shape along the shoulder 3P of the can 1P. In the present embodiment, the external shape of the receiver 11*a* of the inner roll 11 is formed into a bevel shape including a circular truncated cone side part along the shape of the shoulder 3P. Thus, the receiver 11*a* of the inner roll 11 can be formed into the shape closer to the shoulder 3P of the can 1P, and therefore can support the shoulder 3P of the can 1P further firmly in the rotating process described later (see FIG. 5C).

Moreover, both the can 1P and the receiver 11*a* of the inner roll 11 have the circular truncated cone side part having a predetermined angle. In such a circular truncated cone side part, processing force from the inner roll 11 and the outer roll 12 is further easily transmitted to the shoulder 3P, in comparison with side part having a spherical surface-like shape (shape having a convex curvature radius toward a longitudinal section outward direction) and therefore is further preferable.

Figure 4B:
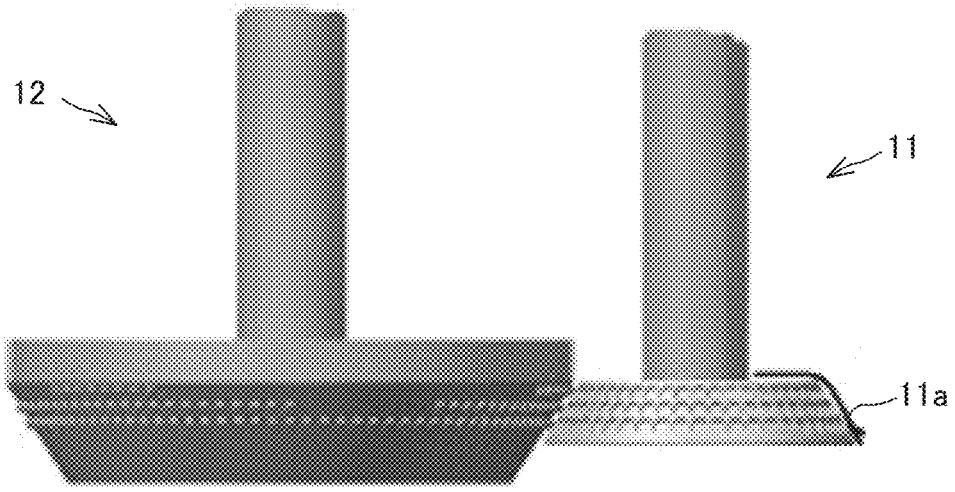
Figure 5A:
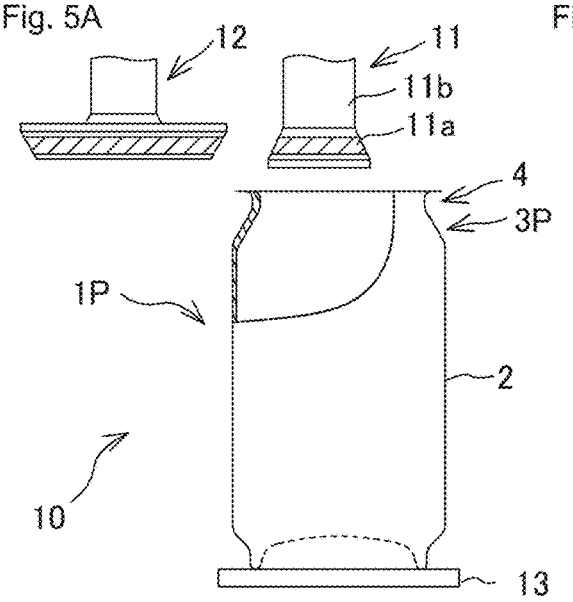
FIGS. 5A to 5E are explanatory diagrams describing a method for manufacturing a can according to the first embodiment by using a schematic view including a partial cross section of the can.
Figure 5D:
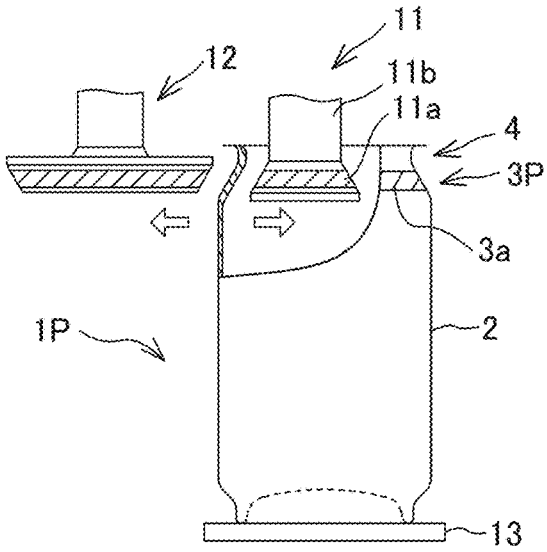
Figure 5B:
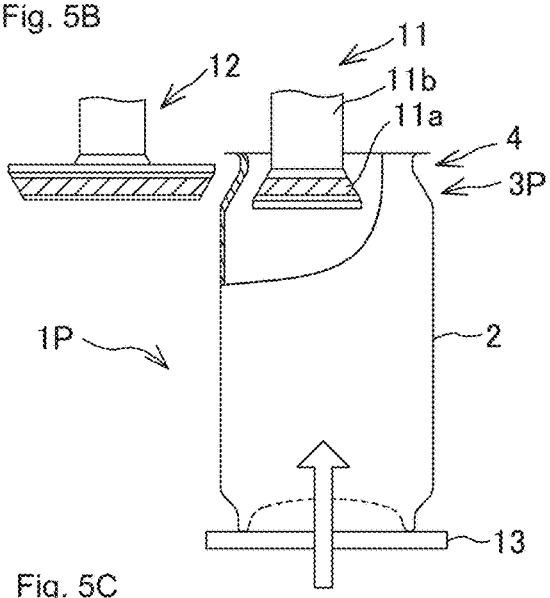
Figure 5E:
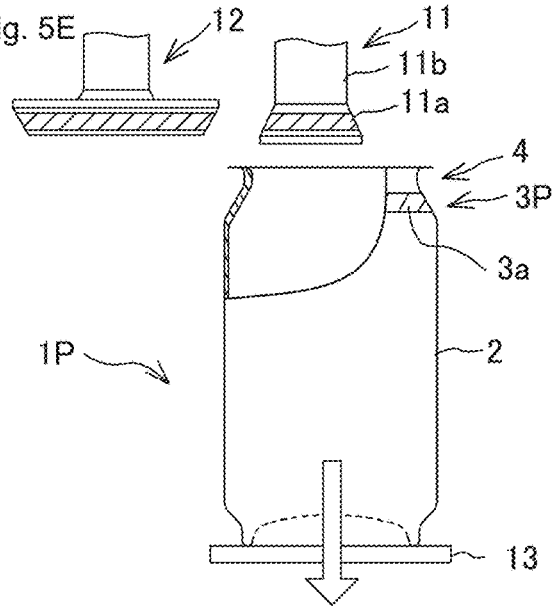
Figure 5C:
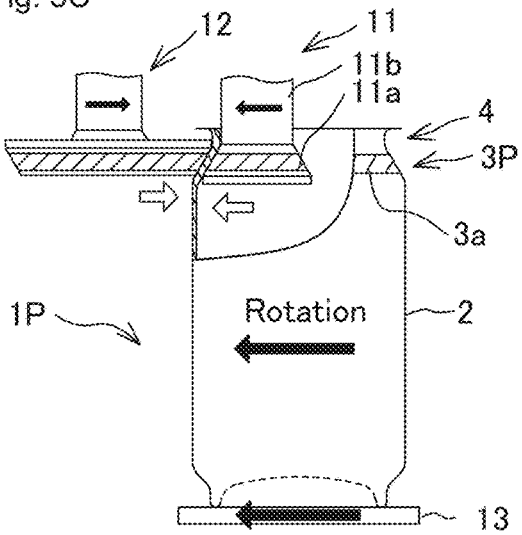

The external shape of the receiver 11*a* of the inner roll 11 may be the shape along the shoulder 3P of the can 1P thoroughly from the outside diameter of the shaft 11*b* to the maximum outer diameter part of the receiver 11*a*, as shown in FIG. 3, FIG. 5C or the like. However, the external shape is not limited thereto, and the external shape of the receiver 11*a* may be the shape formed by allowing only part of the receiver 11*a* to align along the shoulder 3P as shown in FIG. 4A or FIG. 4B, as long as the thickness of the shaft 11*b* can be sufficiently secured.

Moreover, the inclination angle θ of the shoulder 3 of the can 1P according to the present embodiment is set to 10° to 50°. Therefore, in the receiver 11*a* of the inner roll 11, an effective extent for processing the three-dimensionally shaped portion area 3*a* can be secured. Moreover, the inner roll 11 can be inserted into or removed from the mouth 4 even if the shaft 11*b* sufficiently secures the thickness or the wall thickness in view of the strength. Further, upon allowing the inner roll 11 or the outer roll 12 to come close to the shoulder 3 from a radial direction of the can 1P to perform processing of clamping the shoulder 3, the inclination of the shoulder 3 in a normal direction is not excessively steep relative to the direction (the radial direction of the can 1P) in which processing forming force of the can 1P works, and therefore the processing forming force is easily transmitted to the shoulder 3.

It should be noted that the angle θ between the surface formed by extending the shaft 11*b* to a side of the receiver 11*a*, and the side surface of the receiver 11*a* is the same with the angle between the surface formed by extending the above-described shoulder 3 to the side of the body 2, and the body 2.

An external shape of the outer roll 12 only needs to correspond to the receiver 11*a* of the inner roll 11, and formed into the shape capable of uneven rotating processing. In the present embodiment, the inner roll 11 and the outer roll 12 are formed into the bevel shape upside down with each other.

As shown in FIG. 3, when the three-dimensionally shaped portion is formed on a whole circumference of the shoulder 3 of the can 1, a ratio of an outside diameter 11*a*, in a center in the height direction, of the three-dimensionally shaped portion (hatched range), of the receiver 11*a* of the inner roll 11 to an outside diameter G, in the center in the height range, of the three-dimensionally shaped portion of the shoulder 3P of the can 1P may be appropriately set to a smaller ratio (for example, approximately 4/5); however, it is preferably set to the ratio close to "1/natural number of 2 or more", and is set to approximately ½ in the present embodiment.

At this time, an outside diameter φF of the three-dimensionally processing formed portion (hatched range) of the outer roll 12 in the center in the height direction may be arbitrarily adjusted to be larger than the outside diameter φG, as long as the outer roll 12 can respond to unevenness of the receiver 11*a* of the inner roll 11. It should be noted that, when the outside diameter φF is equal to or less than φG, the outside diameter φF is preferably set to a diameter close to "1/natural number" of ρG. In the present embodiment, they are set so as to satisfy the formula: φG=φF.

Moreover, the three-dimensionally shaped portion processing device 10 is equipped with a placing table 13 capable of placing the can 1P thereon, rotating with the can 1P and advancing or retracting the can 1P to or from a position before processing and a processing position. A rotating axis of the placing table 13 and the rotating axis of the inner roll 11 are in parallel to each other. A direction of a rotating axis of the outer roll 12 is not particularly limited as long as the outer roll 12 can follow the inner roll 11 or the shoulder 3P. In FIG. 3, each rotating axis of the placing table 13, the inner roll 11, and the outer roll 12 is arranged to be in parallel to each other.

A rotational speed when the placing table 13 rotates to process the shoulder 3P of the can 1P is preferably 10 to 300 rpm in the case of low speed, and preferably 300 to 700 rpm in the case of high speed, although the rotational speed depends on the shape of the three-dimensionally shaped portion, a material of the can 1P, and other conditions. In the present embodiment, in the case of low speed, the rotational speed is set at 30 rpm, and in the case of high speed, the rotational speed is set at 400 rpm. In association therewith, the rotational speeds of the inner roll 11 and the outer roll 12 are, in view a relationship of a ratio of φ11*a*, φF, and φG, set to 60 rpm and 30 rpm in the case of low speed, respectively, and are set to 800 rpm and 400 rpm in the case of high speed, respectively, in the present embodiment.

It should be noted that, although illustration is omitted, the inner roll 11 or the outer roll 12 is rotated by a rotating drive unit (rotating unit) of the three-dimensionally shaped portion processing device 10.

Next, processing of the three-dimensionally shaped portion of the shoulder 3P according to present embodiment will be described with reference to FIGS. 5A to 5E.

Can placement process: FIG. 5A

The can 1P is placed on the placing table 13 by a conveyor (not shown).

Inner roll insertion process: FIG. 5B

Next, the placing table 13 is allowed to move to move the can 1P to the processing position. Thus, the inner roll 11 is inserted into the can 1P from the mouth 4.

Shoulder clamping process: FIG. 5C

The shoulder 3P is clamped by the receiver 11*a* and the outer roll 12 by allowing the inner roll 11 and the outer roll 12 to relatively come close to the shoulder 3P of the can 1P. More specifically, the receiver 11*a* receives the shoulder 3P from inside, and on the other hand, the outer roll 12 presses the shoulder 3P from outside.

In FIG. 5C, the inner roll 11 and the outer roll 12 moves in the radial direction of the can 1P; however, without being limited thereto, the rolls may move along the direction according to a depressed direction of the concave portion of the three-dimensionally shaped portion, the raised direction of the convex portion, or the like. Thus, when the shoulder 3P is processed by the receiver 11*a* of the inner roll 11 and the outer roll 12, interference can be prevented between parts forming concave or convex patterns on the three-dimensionally shaped portion, or parts forming the concave or convex patterns on the receiver 11*a* of the inner roll 11, parts forming the concave or convex patterns on the outer roll 12, or the like.

Moreover, in the roll retracting process to be described later, also upon separating the inner roll 11 and the outer roll 12 from the shoulder 3P, both may be moved along the direction depending on the depressed direction of the concave portion or the raised direction of the convex portion of the three-dimensionally shaped portion.

Rotating Process: FIG. 5C

In a state of clamping the shoulder 3P by the receiver 11*a* and the outer roll 12 in the clamping process, the inner roll 11 and the outer roll 12 are rotated to integrally rotate the placing table 13 and the can 1P. Then, the can 1P rotates by a predetermined amount (for example, one rotation or more)

to form the three-dimensionally shaped portion in the three-dimensionally shaped portion area 3*a*.

At this time, the shoulder 3P is rotatingly processed in a state of being clamped to the inner roll 11 and the outer roll 12, while the shoulder 3P is reliably supported by the receiver 11*a* of the inner roll 11 from inside. Therefore, the shoulder 3P is hard to cause abnormal deformation, damage or the like, even if the shoulder 3P of the can 1P is thin-walled.

Roll Retracting Process: FIG. 5D

Then, rotation is stopped in the inner roll 11, the outer roll 12, and the placing table 13. Moreover, the inner roll 11 and the outer roll 12 are separated from the shoulder 3P in the radial direction. Thus, the inner roll 11 and the outer roll 12 are retracted to a position of causing non-interference with the can 1P in the height direction of the can 1P.

Can Retracting Process: FIG. 5E

Then, the can 1P is relatively separated from the processing position by moving the placing table 13. As a result, the can 1P is retracted from the processing position.

Moreover, the inner roll 11 and the outer roll 12 move toward the side of the mouth 4 in the height direction to move relatively to the can 1P. Thus, the inner roll 11 moves to an outside of the can 1P from the mouth 4.

Can Retracting Process: FIG. 5(*e*)

Then, the can 1P is relatively separated from the processing position by moving the placing table 13. As a result, the can 1P is retracted from the processing position.

Moreover, the inner roll 11 and the outer roll 12 move toward the side of the mouth 4 in the height direction to move relatively to the can 1P. Thus, the inner roll 11 moves to an outside of the can 1P from the mouth 4.

As described above, according to the method for manufacturing the can of the present embodiment, the three-dimensional shape is formed on the shoulder 3P while the receiver 11*a* of the inner roll 11 receives the shoulder 3P from inside, damage onto the shoulder 3P can be suppressed.

Second Embodiment

Next, a second embodiment of the present invention will be described.

It should be noted that a same reference sign is appropriately applied to a part that fulfils a function similar to the function of the above-described first embodiment, and an overlapping description will be appropriately omitted.

In the second embodiment, each roll in the three-dimensionally shaped portion processing device according to the first embodiment is changed as described below.

Figure 6A:
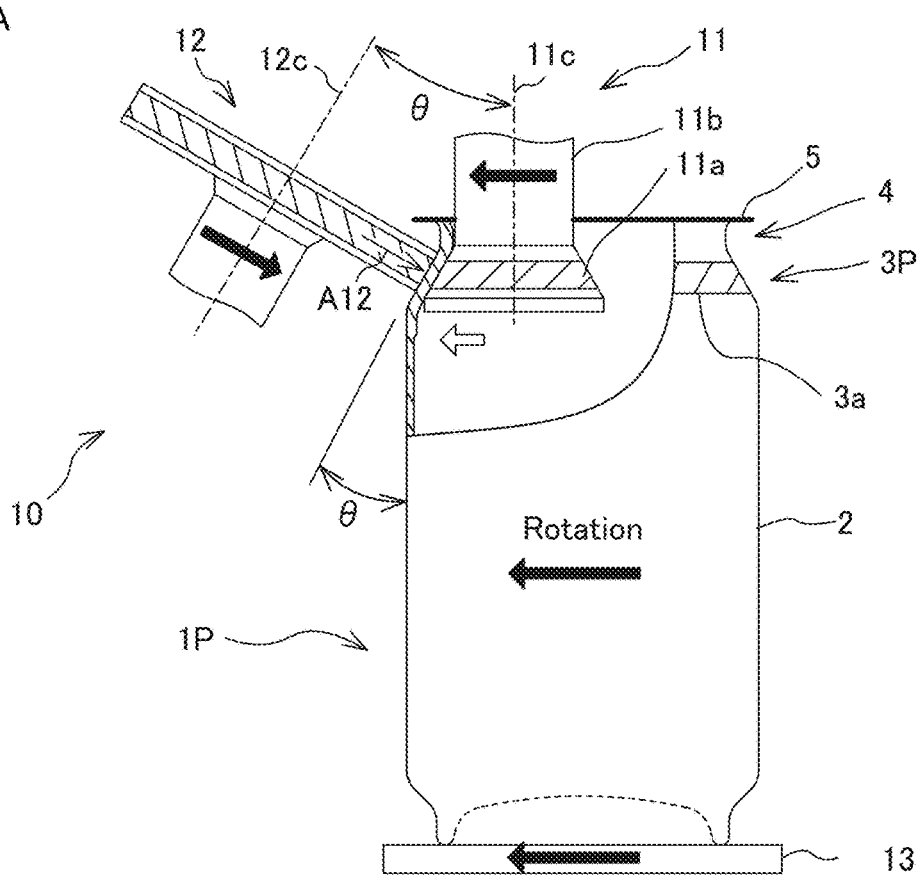
FIGS. 6A and 6B are explanatory diagrams describing an example of an inner roll and an outer roll according to a second embodiment by using a schematic view including a partial cross section of a can.
Figure 6B:
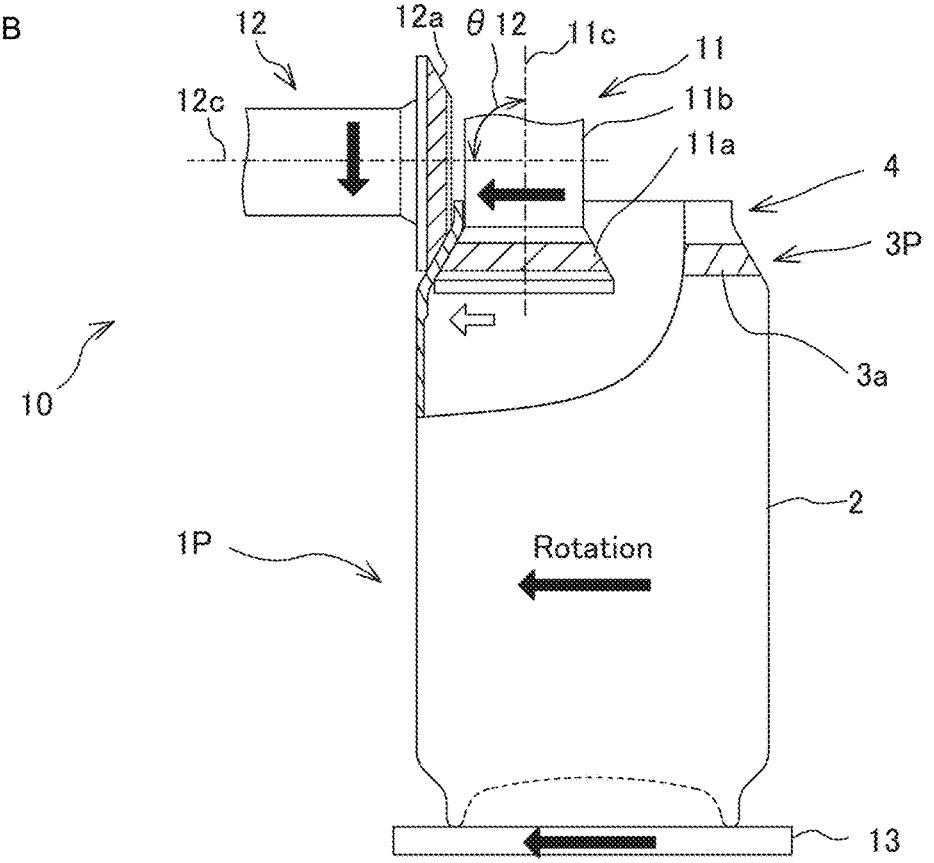

As shown in FIG. 6A or FIG. 6B, the rotating axis 12*c* of the outer roll 12 is not in parallel to the rotating axis of the inner roll 11 or the placing table 13, and is arranged to be in a crossed or twisted position. More specifically, the rotating axis 12*c* of the outer roll 12 and the rotating axis 11*c* of the inner roll 11 are in different directions, and not in parallel to each other.

More specifically, a processing portion of the outer roll 12 shown in FIG. 6A is a columnar member, and not in a circular truncated cone shape as in the first embodiment. The rotating axis 12*c* of the outer roll 12 and an inclined surface of the shoulder 3P are in parallel to each other. Therefore, the rotating axis 12*c* of the outer roll 12 and the rotating axis 11*c* of the inner roll 11 are crossed at the inclination angle θ.

Moreover, a circumferential surface of the outer roll 12 is vertically pressed onto an outer surface of the shoulder 3P (see an arrow A12). Therefore, the circumferential surface of the outer roll 12 and the receiver 11*a* of the inner roll 11 can clamp the shoulder 3P with strong force. Thus, the outer roll 12 and the inner roll 11 can cause improvement in shapability onto the three-dimensionally shaped portion area 3*a*.

The outer roll 12 in FIG. 6B has a circular truncated cone shape diameter reduced portion 12*a* having a shape corresponding to the receiver 11*a* of the inner roll 11. Moreover, the rotating axis 12*c* of the outer roll 12 is perpendicular to the rotating axis 11*c* of the inner roll 11 (see an angle θ12). Thus, the inner roll 11 and the outer roll 12 rotate in a bevel gear form in a state of pressing the shoulder 3P from inside and outside. In a form in FIG. 6B, when the inner roll 11 and the outer roll 12 rotate by clamping the shoulder 3P, both circumferential speeds in a part in which both clamp the shoulder 3P can be adjusted to an equivalent level or a difference between both the circumferential speeds can be reduced. Thus, friction between the shoulder 3P and the inner roll 11 and between the shoulder 3P and the outer roll 12 can be reduced, and therefore the damage or the like onto the shoulder 3P during processing can be suppressed.

Moreover, in the form in FIG. 6A or FIG. 6B, in the three-dimensionally shaped portion processing device 10, a degree of freedom of setting a direction of the rotating axis 11*c* or 12*c* of the inner roll 11 or the outer roll 12 can be increased.

It should be noted that, as shown in FIG. 6B, the can 1P may be a material after forming the shoulder 3P and before forming the flange 5.

Moreover, when the three-dimensionally shaped portion is formed on the shoulder 3P of the can 1P before forming the flange 5 in this manner, then, the shoulder 3P may be widened or expanded to an inside by further reducing the diameter of the mouth 4, whereby the can 1 may be formed into the can having a reduced diameter.

Figure 7:
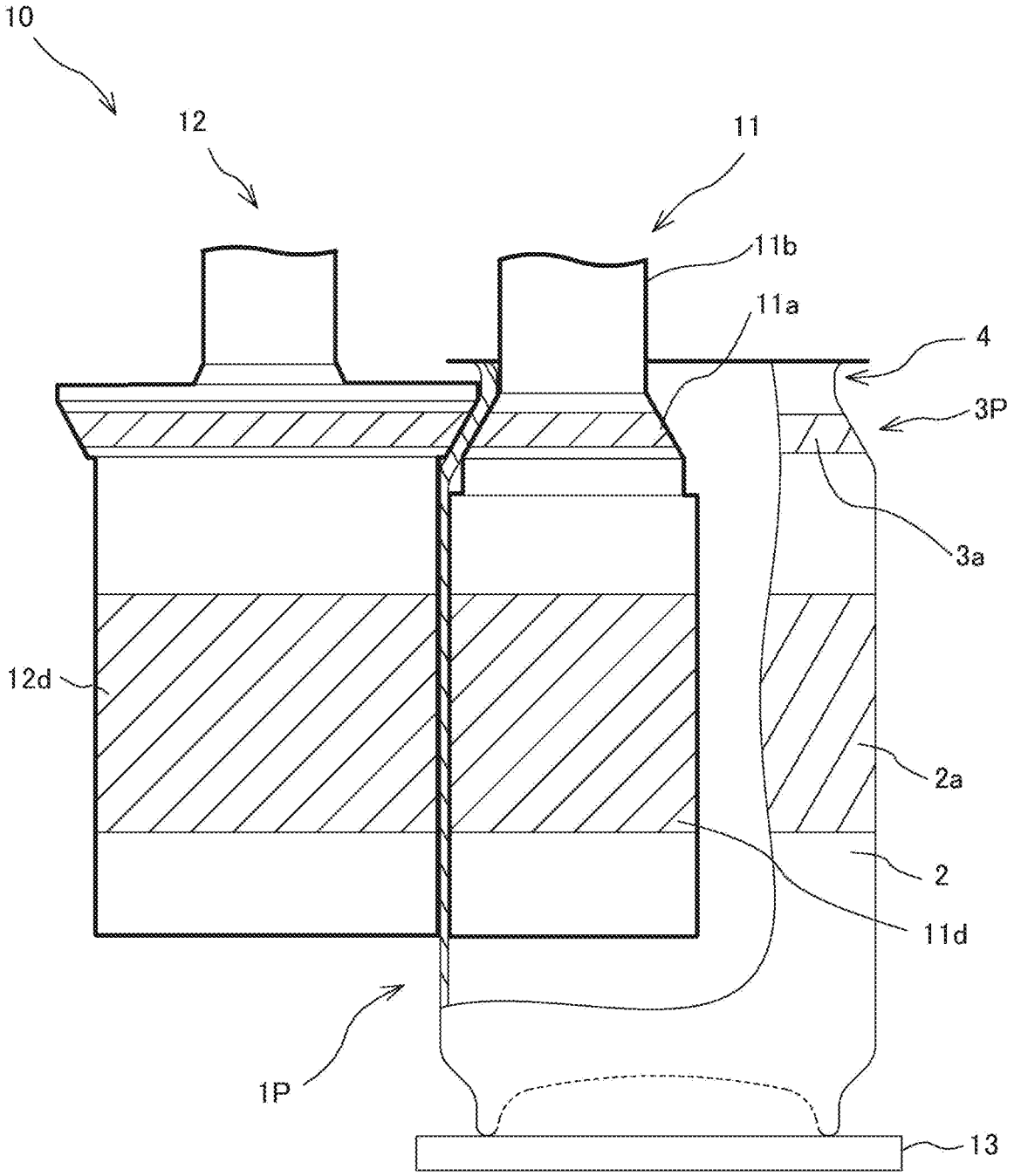
FIG. 7 is an explanatory diagram describing an example of an inner roll and an outer roll according to the second embodiment by using a schematic view including a partial cross section of a can.

The can 1P in FIG. 7 has a three-dimensionally shaped portion area 2*a* also on the body 2, in addition to the shoulder 3P.

The inner roll 11 is provided with a body inner pressing portion 11*d* from the receiver 11*a* toward a downside.

The body inner pressing portion 11*d* is a cylindrical member. The body inner pressing portion 11*d* has, in the range shown by hatching on a circumferential surface thereof, at least one of a concave portion and a convex portion having a shape corresponding to the three-dimensionally shaped portion of the three-dimensionally shaped portion area 2*a*, in a manner similar to the receiver 11*a*.

Similarly, the outer roll 12 is provided with a body outer pressing portion 12*d* from a circular truncated cone part toward the downside.

The body outer pressing portion 12*d* is a cylindrical member. The body outer pressing portion 12*d* has, in the range shown by hatching on the circumferential surface thereof, at least one of a concave portion and a convex portion having a shape corresponding to the body inner pressing portion 11*d*.

During processing the can 1P, simultaneously when the inner roll 11 and the outer roll 12 clamp the shoulder 3P of the can 1P, the body inner pressing portion 11*d* and the body outer pressing portion 12*d* clamp the body 2 from outside and inside. Thus, such a state is formed, in which the body inner pressing portion 11*d* presses the body 2 from inside and the body outer pressing portion 12*d* presses the body 2 from outside. In this state, the inner roll 11 and the outer roll 12 rotate relative to the can 1P, whereby the inner roll 11 and the outer roll 12 can simultaneously form the three-dimensionally shaped portion on the three-dimensionally shaped portion areas 2*a* and 3*a* of the body 2 and the shoulder 3P, respectively.

Thus, the inner roll 11 and the outer roll 12 as shown in FIG. 7 can cause decoration of the body 2 and the shoulder 3P of the can 1P within the same process.

Dimension Setting of can 1 and Inner Roll 11

One example of dimension setting of the can 1 and the inner roll 11 in the above-described embodiment will be described.

Figure 8A:
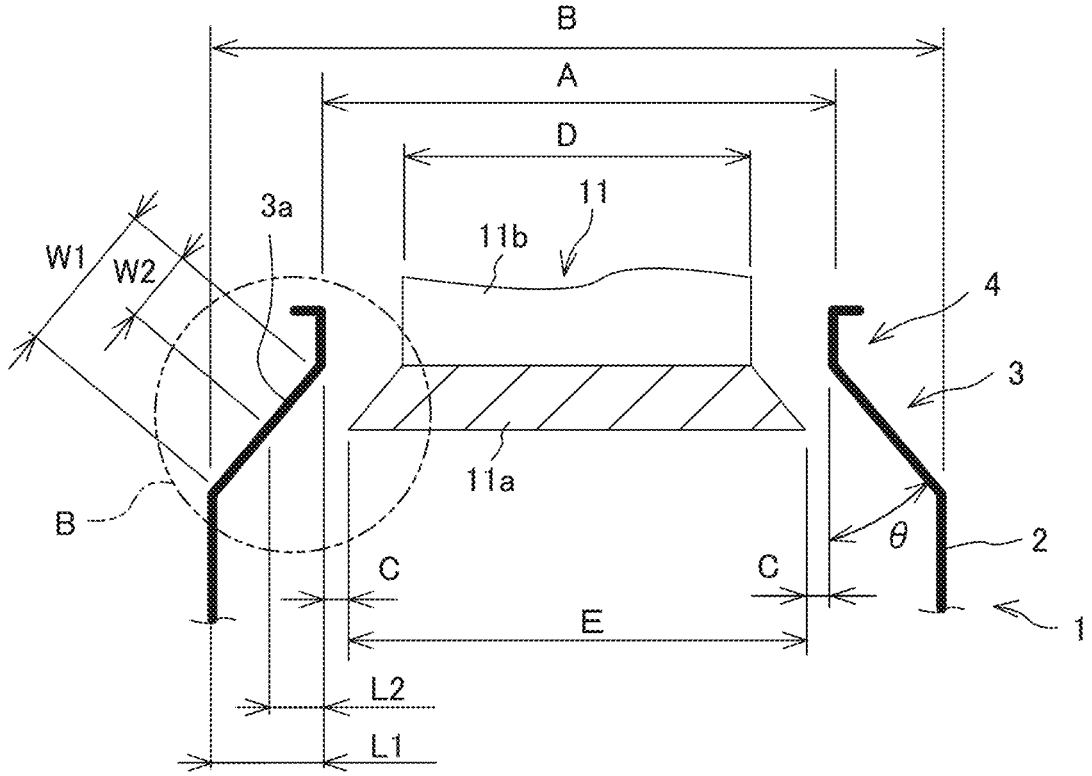
Figure 8A:
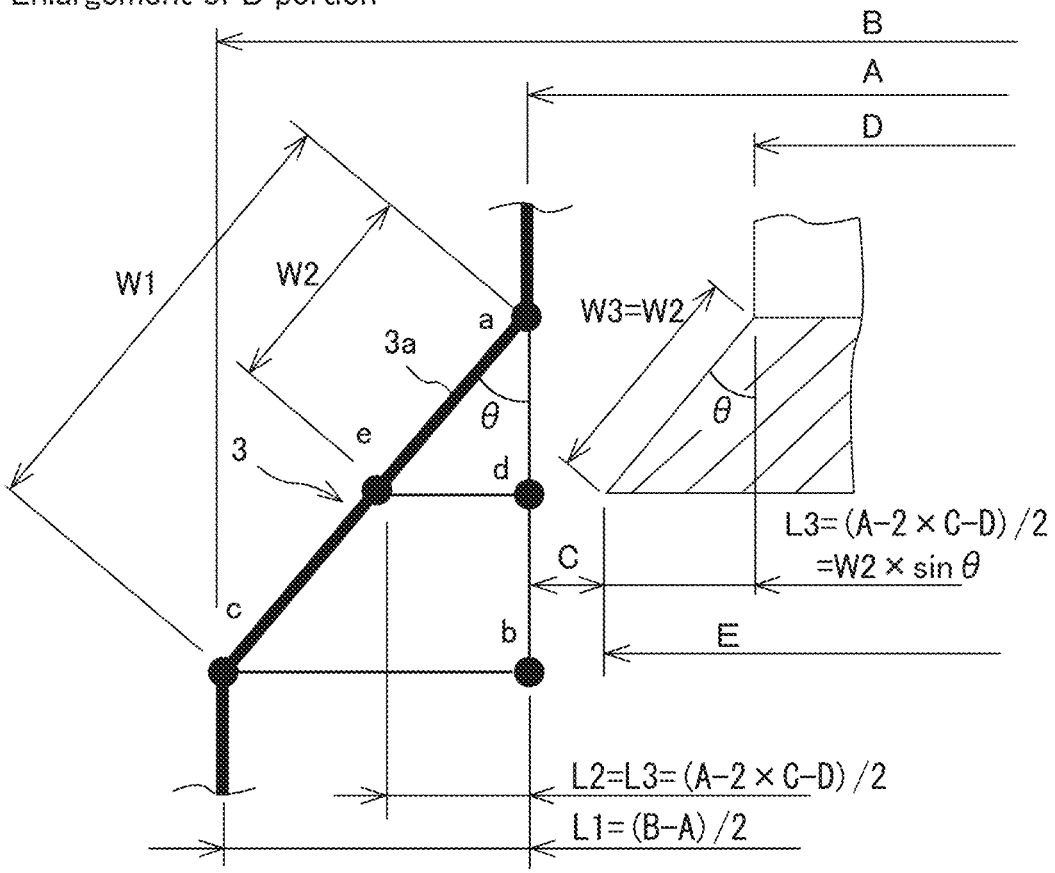

FIG. 8A is an explanatory diagram schematically showing a cross-sectional view of an upper part of the can 1, and schematically showing the inner roll 11.

FIG. 8B shows an enlarged view of B portion in FIG. 8A.

The receiver 11*a* of the inner roll 11 in FIGS. 8A to 8B has a most simple configuration, and formed only of a part corresponding to the three-dimensionally shaped portion area 3*a* of the can 1. Therefore, the circular truncated cone side surface of the receiver 11*a* is wholly in the range in which the convex or the concave corresponding to the three-dimensionally shaped portion of the three-dimensionally shaped portion area 3*a* can be formed.

Each reference sign shown in FIGS. 8A to 8B shows as follows.

A (mm): diameter of a mouth 4 of a can 1

B (mm): maximum outside diameter of a shoulder 3 (namely, a diameter of a body 2 of the can 1)

C (mm): clearance between the mouth 4 of the can 1 and a receiver 11*a*

D (mm): shaft diameter of a shaft 11*b* of an inner roll 11

E (mm): outside diameter of a receiver (maximum outside diameter of the receiver 11*a*)

W1: overall length of the shoulder 3 of the can 1 in a direction along an inclined direction of the shoulder 3

W2: three-dimensionally shaped portion mountable length, namely, a length at which a three-dimensionally shaped portion area 3*a* can be arranged, in the direction along the inclined direction of the shoulder 3 of the can 1, within the range from a root on a side of the mouth 4 toward a side of the body 2 in the shoulder 3

It should be noted that an example in FIGS. 8A and 8B is provided for describing a basic concept of dimension setting, and a thickness of the can 1 is not taken into consideration. If the thickness thereof is taken into consideration, the thickness can be appropriately set as "B: maximum outside diameter of the shoulder 3 of the can 1" and "A: inside diameter of the mouth 4 of the can 1", or the like.

As shown in FIG. 8B, in a dimension of the can 1, a radial length corresponding to each of the length W1 and W2 is a length L1 of a side be of a triangle abc and a length L2 of a side de of a triangle ade, and the length L1 can be represented by the following formula.

$$L1=(B-A)/2$$

Moreover, a protrusion length L3 of the receiver 11*a* is equal to the length L2 in the radial direction.

Therefore, the length L2 can be represented by the following formula.

$$L2=L3$$

$$L2=(A-2\times C-D)/2$$

The triangle abc and the triangle ade are similar, and therefore the following relationship holds.

$$W2/W1=L2L1=[(A-2\times C-D)/2]/[(B-A)/2]$$

$$W2/W1=(A-(2\times C+D))/(B-A)$$

The above-described formulas can be arranged into the following formula.

$$2\times C+D=A-(B-A)\times W2/W1 \qquad \text{Formula 1}$$

Here, the clearance C (mm) preferably satisfies a formula: "1≤C" in consideration of actual processability. Moreover, in consideration of strength of the shaft 11*b*, the shaft diameter D (mm) preferably satisfies a formula: "10≤D". Then, with respect to Formula 1, the following relational formula holds.

$$12\leq A-(B-A)\times W2/W1 \qquad \text{Formula 2}$$

More specifically, the can 1 satisfying Formula 2 produces an effect of favorable processability because a sufficient clearance for inserting or removing the inner roll 12 into or from the mouth 4, and the strength of the shaft 11*b* can be sufficiently secured.

Further, for example, the can 1 in which Formula 2 and a formula: "W2/W1≤0.5" hold produces, in addition to the above-described effect, an effect of being capable of arranging the three-dimensionally shaped portion area 3*a* in a part up to a half of the shoulder 3 in the range from the root on the side of the mouth 4 of the shoulder 3 toward the side of the body 2.

Moreover, the can 1 in which Formula 2 and a formula: "W2/W1≤1" hold produces, in addition to the above-described effect, an effect of being capable of arranging the three-dimensionally shaped portion area 3*a* in the whole range of the shoulder 3.

Next, dimension setting of the inner roll 11 will be described.

A length W3 of an inclined surface of the circular truncated cone side surface of the receiver 11*a* is equal to the three-dimensionally shaped portion mountable length W2.

Therefore, in the radial direction, the protrusion length L3 of the receiver 11*a* can be represented by the following formula.

$$L3=W3\times\sin\theta=W2\times\sin\theta$$

Therefore, a receiver outside diameter E can be represented by the following formula.

$$E=D+2\times L3$$

$$E=D+2\times W2\times\sin\theta$$

Here, in order to insert the receiver 11*a* (outside diameter: E) into the mouth 4 (diameter: A), the following formulas need to be satisfied.

$$E+2\times C\leq A$$

$$D+2W2\times\sin\theta+2\times C\leq A$$

The above-described formulas can be arranged into the following formula.

$$D\leq A-2\times(C+W2\times\sin\theta) \qquad \text{Formula 3}$$

More specifically, the inner roll 11 produces an effect of being capable of processing the shoulder 3 of the can 1 because the inner roll 11 can be inserted into or removed from the mouth 4 by satisfying Formula 3.

Further, the clearance C (mm) preferably satisfies the formula: 1≤C as described above. Therefore, in the inner roll 11, processability can be improved by satisfying the formula: 1≤C, in addition to Formula 3.

As described above, the embodiments of the present invention have been described, but the present invention is not limited the embodiments described above, and numerous modifications or changes described later can be made, and such modifications or changes are within the technical scope of the present invention. Moreover, the effects described in the present embodiments are only examples of the most preferable effects of the present invention, and the advantageous effects of the present invention are not limited to the effects described in the embodiments. It should be noted that each structure of the embodiments described above and modified embodiments described later can be appropriately combined and used, but the detailed description thereof is omitted.

Modified Embodiment (1) As in the outer roller 102 in FIGS. 4A and 4B in Patent Document 1 or the outer roll 4 as shown in FIGS. 2A and 2B, FIG. 3 or the like in JP 2011-005512 A, in the outer roll, a place to which rotating processing is performed may be formed into a large diameter portion, and a place into or from which the can is inserted or ejected may be formed into a small diameter portion. Then, a device configuration for inserting the can thereinto, rotating processing of the shoulder or ejecting the can therefrom may be formed by forming a can holding means (placing table) into a structure movable in forward and backward relative to the inner roll.

(2) Upon widening or expanding the shoulder, the three-dimensionally shaped portion can be further provided on the widened or expanded shoulder by further using the method for processing the three-dimensionally shaped portion according to the present invention. Further, upon providing the three-dimensionally shaped portion, in order to align the three-dimensionally shaped portion formed in the preceding process with patterns or the like, a configuration may be formed in such a manner setting can be made by detecting a print mark or unevenness of the can, determining a reference position, and determining the processing position thereto.

Figure 9:
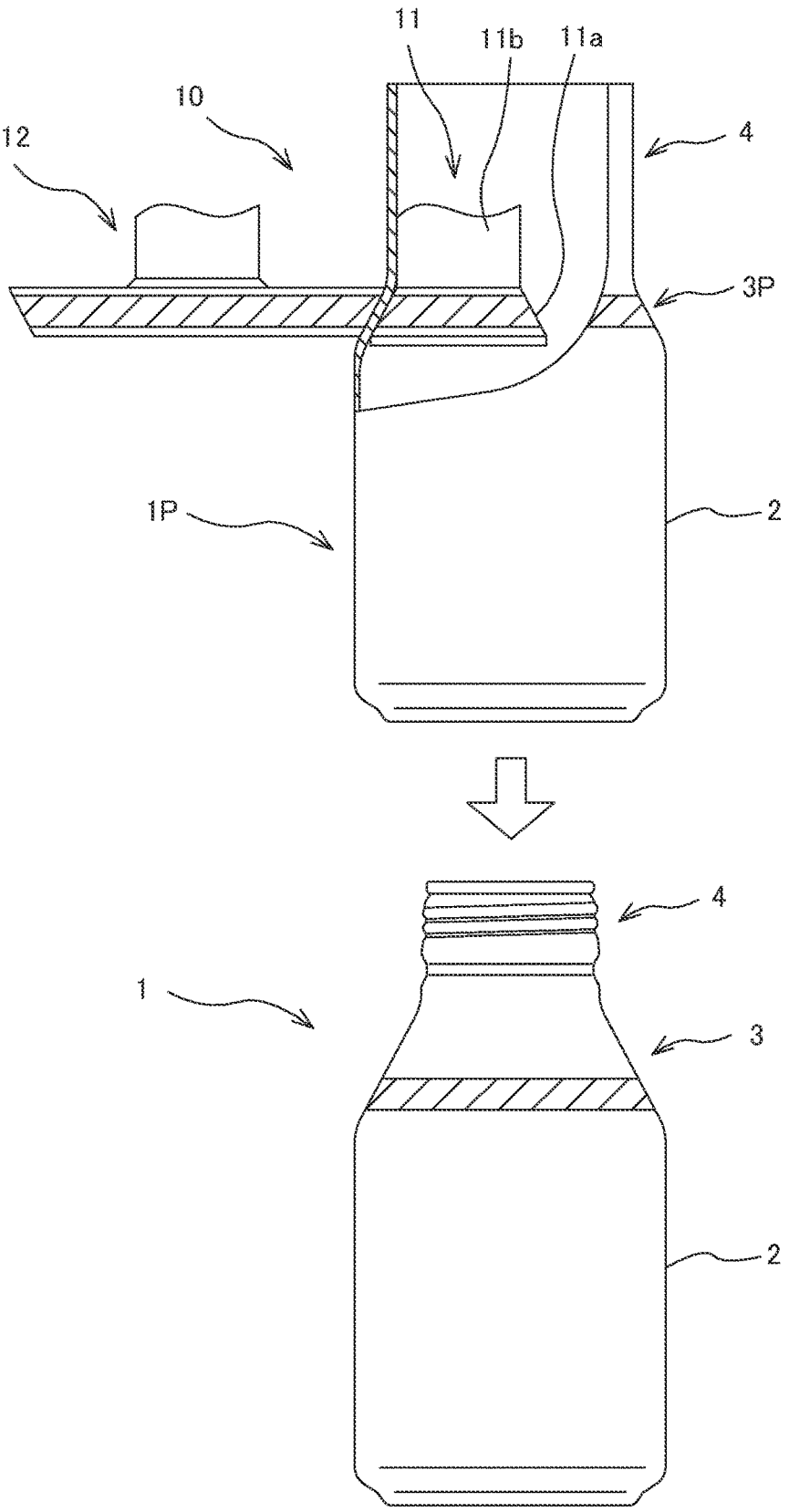
FIG. 9 is an explanatory diagram describing an example of a threaded portion being formed by reducing a diameter of a mouth of the can after forming a three-dimensionally shaped portion, according to an embodiment.

(3) In the method for manufacturing the can, a threaded portion forming process is provided after the rotating processing for forming the three-dimensionally shaped portion, whereby the can may be formed as a thread can in which a jaw, a threaded portion, a curled portion or the like is formed on the mouth of the can having a reduced diameter. An example of the threaded portion forming process is illustrated in FIG. 9.

(4) The can may be a three piece can in which the bottom, the body, and the lid are formed of members different from each other. In this case, the three-dimensionally shaped portion may be formed on the body before the bottom and the lid are provided. Moreover, in this case, the inner roll may be inserted into the can from the side of the bottom, and not from the side of the mouth.

(5) In the embodiment, the example in which the three-dimensionally shaped portion is formed on the shoulder of the can is described; however, the portion is not limited thereto. For example, the three-dimensionally shaped portion may be formed on the chime portion of the can. More specifically, the chime portion may be deemed as one form of the shoulder.

(6) In the embodiment, the example in which the shoulder of the can is a linearly inclined inclination part is described, but the shoulder is not limited thereto. The shoulder of the can may be, for example, a curved curve part, or the like. In this case, a processing surface of the inner roll or the outer roll only needs to have a curved surface or the like corresponding to the curved part or the like. Moreover, in this case, each structure of the embodiment is appropriately modified so as to correspond to the curved part or the like, whereby the shoulder having the curved part or the like can be processed by applying a concept of the embodiment.

The entire contents of the documents described in this description and the description of the Japanese application serving as a basis of claiming the priority concerning the present application to the Paris Convention are incorporated by reference herein.

REFERENCE SIGNS LIST

1, 1P Can
2 Body
2*a*, 3*a* Three-dimensionally shaped portion area
3, 3P Shoulder
4 Mouth
Flange
Three-dimensionally shaped portion processing device
11 Inner roll
11*a* Receiver
11*b* Shaft
11*d* Body inner pressing portion
12 Outer roll
12*a* Diameter reduced portion
12*d* Body outer pressing portion
13 Placing table

The invention claimed is:

1. A method for manufacturing a can comprising:

forming a shoulder reduced in a diameter toward a side of a mouth of the can on a side of an upper end of a cylindrical body of the can in a can axis direction, wherein the shoulder has an inclination angle of 10° to 50° between a surface formed by extending the shoulder to a side of the body and the body, and a thickness of 0.1 to 0.3 mm, inserting an inner roll into the can from the mouth, wherein the inner roll comprises a shaft serving as a rotating axis of the inner roll and a receiver connected to the shaft at a bottom of the inner roll, and the receiver, has at least one of a concave portion and a convex portion, has a maximum outside diameter smaller than an inside diameter of the mouth, and has an external shape of a bevel shape along a shape of the shoulder;

receiving the shoulder inclined at said inclination angle from inside with the receiver of the inner roll;

pressing the shoulder from outside with an outer roll, wherein the outer roll has at least one of a concave portion and a convex portion corresponding to at least one of the concave portion and the convex portion provided on the receiver of the inner roll; and forming a three-dimensionally shaped portion on the shoulder by rotating the inner roll and the outer roll relative to the can, in a state in which the receiver of the inner roll and the outer roll clamp the shoulder from outside and inside.

2. The method for manufacturing the can according to claim 1, wherein a ratio of a maximum outside diameter of the shoulder to an inside diameter of the mouth of the can is 1.05 to 1.58.

3. The method for manufacturing the can according to claim 1, wherein a threaded portion is formed by reducing a diameter of the mouth after forming the three-dimensionally shaped portion.

4. The method for manufacturing the can according to claim 1, further comprising:

pressing the body of the can from inside with a body inner pressing portion provided on the inner roll, wherein the body inner pressing portion has, at least one of the concave portion and the convex portion for forming the three-dimensionally shaped portion also on the body in addition to the shoulder;

pressing the body of the can from outside with a body outer pressing portion provided on the outer roll, wherein the body outer pressing portion has at least one of the concave portion and the convex portion corresponding to at least one of the concave portion and the convex portion provided on the body inner pressing portion; and forming the three-dimensionally shaped portion also on the body by rotating the inner roll and the outer roll relative to the can, in a state in which the body inner pressing portion and the body outer pressing portion clamp the body from outside and inside.

5. The method for manufacturing the can according to claim 1, wherein the outer roll has a diameter reduced portion corresponding to the receiver of the inner roll;

the inner roll and the outer roll have rotating axes having directions different from each other; and rotate in a state of pressing the shoulder from inside and outside.

6. The method for manufacturing the can according to claim 1, wherein an inside diameter of the mouth is 25 mm to 60 mm; and a maximum outside diameter of the shoulder is 50 mm to 70 mm.

7. The method for manufacturing the can according to claim 1, wherein an angle θ between a surface formed by extending the shaft of the inner roll to a side of the receiver, and the receiver is 10° to 50°.

8. The method for manufacturing the can according to claim 1, wherein a formula:

$$D \leq A - 2 \times (C + W2 \times \sin\theta)$$

is satisfied, when a diameter of the shaft of the inner roll is taken as D;

an inside diameter of the mouth is taken as A;

a length of the receiver is taken as W2;

a clearance between the mouth and the shaft receiver of the inner roll is taken as C; and an angle between a surface formed by extending the shaft of the inner roll to a side of the receiver, and the receiver is taken as θ.

9. The method for manufacturing the can according to claim 1, wherein a formula:

$$12 \leq D \leq A - 2 \times (C + W2 \times \sin\theta), \text{ and } 1 \leq C$$

is satisfied, when a diameter of the shaft of the inner roll is taken as D (mm);

an inside diameter of the mouth is taken as A (mm);

a length of the receiver is taken as W2 (*mm*);

a clearance between the mouth and the receiver of the inner roll is taken as C (mm); and an angle between a surface formed by extending the shaft of the inner roll to a side of the receiver, and the receiver is taken as θ.

* * * * *